US008475628B1

(12) United States Patent
Abbott et al.

(10) Patent No.: US 8,475,628 B1
(45) **Date of Patent: *Jul. 2, 2013**

(54) PROCESS AND APPARATUS FOR ORIENTING BAST STALKS FOR DECORTICATION

(75) Inventors: Michael D. Abbott, Statesville, NC (US); Robert A. Miller, New Ringgold, PA (US)

(73) Assignee: HBI Branded Apparel Enterprises, LLC, Winston-Salem, NC (US)

( * ) Notice: Subject to any disclaimer, the term of this patent is extended or adjusted under 35 U.S.C. 154(b) by 47 days.

This patent is subject to a terminal disclaimer.

(21) Appl. No.: 13/074,665

(22) Filed: Mar. 29, 2011

(51) Int. Cl.
*A01H 5/02* (2006.01)

(52) U.S. Cl.
USPC ..... 162/98

(58) Field of Classification Search
USPC ..... 162/98, 21, 28, 286, 272, 48, 99, 162/150; 156/512; 144/357; 56/131
See application file for complete search history.

(56) References Cited

U.S. PATENT DOCUMENTS

| | | | |
|---|---|---|---|
| 19,394 | A | 2/1858 | Whipple |
| 34,619 | A | 3/1862 | Comly |
| 59,503 | A | 11/1866 | Clemens |
| 464,056 | A | 12/1891 | Armstrong |
| 559,354 | A | 5/1896 | Birchall |
| 593,772 | A | 11/1897 | Linneborn |
| 611,108 | A | 9/1898 | Drury |
| 701,770 | A | 6/1902 | Smith |
| 738,783 | A | 9/1903 | Ellis |
| 738,893 | A | 9/1903 | Ellis |
| 874,460 | A | 12/1907 | Vessot |
| 1,327,297 | A | 1/1920 | Summers |
| 1,531,320 | A | 3/1925 | Summers |
| 1,835,454 | A | 12/1931 | Bartosz |
| 2,111,925 | A | 3/1938 | Eves |
| 2,111,926 | A | 3/1938 | Eves |
| 2,208,287 | A | 7/1940 | Cochrane |
| 2,296,524 | A | 9/1942 | Heritage |
| 2,313,791 | A | 3/1943 | Widger |
| 2,338,308 | A | 1/1944 | Thompson |
| 2,346,585 | A | 4/1944 | Job |
| 2,387,796 | A | 10/1945 | Jones |

(Continued)

FOREIGN PATENT DOCUMENTS

| | | | |
|---|---|---|---|
| BE | 893541 | A2 | 12/1982 |
| DE | 3639022 | C1 | 4/1988 |

(Continued)

OTHER PUBLICATIONS

John A. Foulk, et al. Flax-cotton Fiber Blends: Miniature Spinning, Gin Processing, and Dust Potential, ScienceDirect, Industrial Crops and Products 25, 2007, 8-16, 25, Elsivier. http://ddr.nal.usda.gov/bitstream/10113/19324/1/IND43888517.pdf.

(Continued)

*Primary Examiner* — Mark Halpern
(74) *Attorney, Agent, or Firm* — Womble Carlyle Sandridge & Rice LLP

(57) ABSTRACT

A process and apparatus for orienting a plurality of bast stalks for decortication includes receiving a plurality of harvested bast stalks onto a moving belt. The belt has a longitudinal axis in the direction the belt is moving. The process and apparatus orients a substantial portion of the plurality of harvested bast stalks on the belt so that the harvested bast stalks are generally parallel to the longitudinal axis of the belt. The oriented plurality of bast stalks may be collected for decortication.

21 Claims, 7 Drawing Sheets

U.S. PATENT DOCUMENTS

| | | | |
|---|---|---|---|
| 2,391,977 | A | 1/1946 | Johansen |
| 2,460,448 | A | 2/1949 | Cook |
| 2,468,771 | A | 5/1949 | Montonna et al. |
| 2,667,733 | A | 2/1954 | Bolelli |
| 2,741,894 | A | 4/1956 | Schulze |
| 2,883,826 | A | 4/1959 | Smith et al. |
| 2,891,368 | A | 6/1959 | Yovanovich |
| 2,905,974 | A | 9/1959 | Cary et al. |
| 3,670,490 | A | 6/1972 | Kneafsey |
| 3,716,981 | A | 2/1973 | Bok |
| 3,872,545 | A | 3/1975 | Altosaar |
| 3,979,177 | A | 9/1976 | Selling et al. |
| 4,241,474 | A | 12/1980 | Doutre |
| 5,020,311 | A | 6/1991 | Matthies |
| 5,036,653 | A | 8/1991 | Klinner |
| 5,103,626 | A | 4/1992 | Morrison |
| 5,323,774 | A | 6/1994 | Fehlauer |
| 5,466,188 | A | 11/1995 | Schaal et al. |
| 5,513,805 | A | 5/1996 | Fisher et al. |
| 5,632,135 | A | 5/1997 | Baker, IV et al. |
| 5,666,696 | A | 9/1997 | Costard |
| 5,916,798 | A | 6/1999 | Lund et al. |
| 5,970,700 | A | 10/1999 | Scheerer et al. |
| 6,250,060 | B1 | 6/2001 | Scheerer et al. |
| 6,539,585 | B1 | 4/2003 | Anthony |
| 6,615,454 | B1 | 9/2003 | Anthony |
| 6,685,748 | B1 | 2/2004 | Day et al. |
| 6,805,718 | B2 | 10/2004 | Barfoed et al. |
| 6,820,406 | B2 | 11/2004 | Khavkine et al. |
| 6,912,876 | B2 | 7/2005 | Wallis et al. |
| 6,979,491 | B2 | 12/2005 | Yan et al. |
| 7,468,333 | B2 | 12/2008 | Kimbrell, Jr. et al. |
| 7,481,843 | B2 | 1/2009 | Xu |
| 7,520,214 | B2 | 4/2009 | Dehondt |
| 7,669,292 | B2 | 3/2010 | Chute et al. |
| 2003/0157323 | A1 | 8/2003 | Khavkine et al. |
| 2003/0226215 | A1 | 12/2003 | Barfoed et al. |
| 2004/0191888 | A1 | 9/2004 | Clarke et al. |
| 2007/0094810 | A1 | 5/2007 | Xu |
| 2007/0199669 | A1 | 8/2007 | Yang et al. |
| 2008/0096001 | A1 | 4/2008 | Emden et al. |
| 2009/0007538 | A1 | 1/2009 | Cheng et al. |
| 2009/0092835 | A1 | 4/2009 | Xu |
| 2009/0293443 | A1 | 12/2009 | Silver |
| 2010/0147472 | A1 | 6/2010 | Sung et al. |
| 2010/0285569 | A1 | 11/2010 | Xiao et al. |

FOREIGN PATENT DOCUMENTS

| | | | |
|---|---|---|---|
| DE | 3735235 | A1 | 4/1989 |
| DE | 3815771 | A1 | 11/1989 |
| EP | 0332726 | A1 | 9/1989 |
| EP | 0398421 | A1 | 11/1990 |
| FR | 2866515 | A1 | 8/2005 |
| GB | 167962 | A | 8/1921 |
| GB | 218665 | A | 9/1925 |
| GB | 308387 | A | 3/1929 |
| GB | 2205865 | A | 12/1988 |
| WO | WO-9801611 | A1 | 1/1998 |
| WO | WO-9845514 | A1 | 10/1998 |
| WO | WO-0002433 | A2 | 1/2000 |
| WO | WO-0044968 | A1 | 8/2000 |
| WO | WO-0148300 | A1 | 7/2001 |
| WO | WO-2007140578 | A1 | 12/2007 |
| WO | WO-2009092865 | A1 | 7/2009 |

OTHER PUBLICATIONS

Swicofll AG Textile Services. Natural Fibres/Synthetic Fibres: Flax (Linen). http://swicofil.com/products/003flax.html; date unknown, available as of filing date.

Flax Council of Canada. Growing Flax. http://www.flaxcouncil.ca/english/index.jsp?p=growing12&mp=growing.; date unknown, availabe as of filing date.

David McAlister, III, et al. Cotton Fibers: Properties and Interaction with Flax Fibers in Blends (Focus on Rotor Spun Yarn), United States Department of Agriculture, Agricultural Research Service, Mar. 15, 2004. hftp://www.ars.usda.gov/research/publications/publications.htm?seq__no__115=146395.

Waldemar Cierpucha, at al. Applicability of Flax and Hemp as Raw Materials for Production of Cotton-like Fibres and Blended Yarns in Poland, Fibres and Textiles in Eastern Europe, Jul./Oct. 2004, 13-18, 12:3(47). http://fibtex.lodz.pl/47__06__13.pdf.

Tadeusz Jackowski, et al. Modelling of the Relationship Between Feeding Sliver Structures and Parameters of Cotton/Linen Blended Yarns, Fibres and Textiles in Eastern Europe, Apr./Jun. 2003, 12-17, 11:2(41). http://www.fibtex.lodz.pl/41__06/__12.pdf.

Rosalie Marion Bliss, Flax Fiber Offers Cotton Cool Comfort, Agricultural Research Magazine, Nov. 2005, 53(11). http://www.ars.usda.gov/is/ar/archive/nov05/fiber/1105.htm?pf=1.

John A. Foulk, et al. Fiber Flax Farming Practices in the Southeastern United States, Plant Management Network. Crop Management, Jan. 24, 2003.

Flax Counsel of Canada. Harvesting. http://www.flaxcouncil.ca/english/print.jsp?p=growing10&mp=growing; date unknown, available as of filing date.

PROCESS AND APPARATUS FOR ORIENTING BAST STALKS FOR DECORTICATION

CROSS-REFERENCE TO RELATED APPLICATIONS

This application is related to co-pending U.S. application Ser. No. 13,074,778, filed Mar. 29, 2011.

FIELD OF THE INVENTION

The present invention relates to a process and apparatus for arranging bast stalks for decortication, and particularly to a process and apparatus that orients bast stalks that have been harvested from a field.

BACKGROUND OF THE INVENTION

Bast plants have a remarkable variety of uses. Bast fibers extracted from these plants are used in textiles, apparel, ropes and cordage, paper and composite fabrication, among other applications. The bast fibers can provide unique properties in textile structures, while providing alternative, renewable, fiber supplies for cotton based and/or petroleum based fiber materials. Bast seeds yield oils for several end-uses, e.g., food grade oils, personal care products, paint additives, etc. Bast plants are compelling crops to harvest due to the broad uses, the wide geographic footprint most bast plants have for growing, and the typical yields.

Despite the variety of uses for bast plants, these plants have been developed toward either seed production or fiber production, but not necessarily seed and fiber production. More specifically, bast plants that primarily yield seeds for oil production and planting, however, do not typically produce the fibers suitable for textile production. Bast plants for seed production may have short fiber lengths and lower fiber yields. For example, flax plants (*Linum usitatissimum* L.) for fibers are taller, yield more fiber, have lower oilseed content and produce less seeds compared to flax plants for seed production. In addition, bast seed plant production substantially outpaces the production of bast fiber plants, thus bast fibers suitable for textile applications have a limited supply.

Extracting fibers from bast plants and conditioning them into a state suitable for yarn and fabric formation is a complex, expensive process. Typically, bast plants are cut, laid in the field and the stalks are allowed to rett for some period of time, e.g., a week to a month or more depending on the climate. Retting begins the process of separating pertinacious materials from the fibers, and the fibers from the woody core of the plant. The retted stalks are then decorticated. Decortication as used herein means removing the outer layers of the stalk and exposing the fibers. Following decortication, the fibers are intended for yarn formation, typically using long-line or wet-yarn spinning systems, as is known the art.

Harvesting through decortication, however, does not necessarily produce fibers suitable for modern high speed yarn spinning operations, e.g., cotton and/or cotton blend spinning systems. The amount of capital investment in process modifications required to process bast fibers on existing spinning systems exceeds the return that running such fibers on those systems could provide.

There is a need, therefore, to address the processing of bast plants prior to decortication so that the fibers resulting from decortication are better suited for modern yarn spinning systems.

SUMMARY OF THE INVENTION

A process and apparatus for orienting a plurality of bast stalks for decortication includes receiving a plurality of harvested bast stalks onto a moving belt. The belt has a longitudinal axis in the direction the belt is moving. The process and apparatus orients a substantial portion of the plurality of harvested bast stalks on the belt so that the harvested bast stalks are generally parallel to the longitudinal axis of the belt. The oriented plurality of bast stalks may be collected for decortication.

These and other features, aspects, and advantages of the invention will be apparent from a reading of the following detailed description together with the accompanying drawings, which are briefly described below.

DETAILED DESCRIPTION

Figure 1:
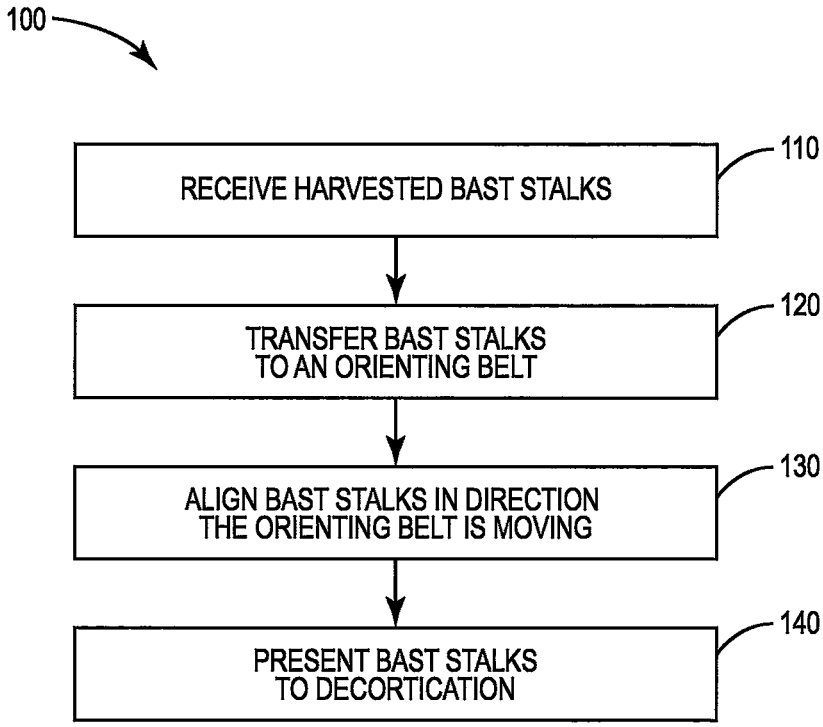
FIG. 1 is diagram of an exemplary process according to an embodiment of the invention.

Certain exemplary embodiments of the present invention are described below and illustrated in the accompanying figures. The embodiments described are only for purposes of illustrating the present invention and should not be interpreted as limiting the scope of the invention, which, of course, is limited only by the claims below. Other embodiments of the invention, and certain modifications and improvements of the described embodiments, will occur to those skilled in the art and all such alternate embodiments, modifications, and improvements are within the scope of the present invention.

According to common practice, the various features of the drawings discussed below are not necessarily drawn to scale. Dimensions of various features and elements in the drawings may be expanded or reduced to more clearly illustrate the embodiments of the invention.

FIG. 1 shows an exemplary process 100 for arranging bast stalks for decortication that have been harvested from bast plants in a field. Bast plants as used herein means plants having a fibrous layer surrounding a woody core, and may include, but is not limited to, flax, hemp, kenaf, and ramie. Further, bast plants intended for either seed or fiber production may be used in the process and apparatus as described herein.

Orienting bast stalks better prepares the bast stalks for decortication, and ultimately fiber preparation and yarn spinning. Having bast stalks aligned in a generally parallel orientation with respect to each other as they are presented to decortication can improve fiber preparation and yarn spinning. For example, one purpose of fiber preparation, sliver formation, and the drafting processes in yarn spinning systems is to form fiber assemblies having fibers arranged substantially parallel and minimal mass variation along the length of the assembly. Highly aligned fiber assemblies with low mass variation have lower end breaks thereby increasing yarn efficiency, and yielding a stronger, smoother yarn. By aligning the bast stalks in parallel early in the fiber extraction process, the bast fibers obtained via decortication will be better suited to operate on existing cotton and cotton blend yarn spinning systems.

Continuing with FIG. 1, the process 100 initiates by receiving harvested bast stalks (block 110). Harvested bast stalks are cut from plants in the field and packaged in a round bale or other package, prior to the retting, as will be detailed below. Any bale type may be used, e.g., square or rectangular bales. The bast stalks are then transferred to an orienting belt (block 120). The transfer step will be further described below. The process then aligns the bast stalks on the belt so that they are oriented generally in the direction the belt is moving (block 130). A belt may be any apparatus for conveying objects. Next, the oriented bast stalks are then presented to a decortication apparatus (block 140). Alternatively, as will be discussed below, the oriented bast stalks can be collected and packaged for transport to a decortications apparatus.

While the process can be used for bast stalks generally, in one embodiment, the process may be used to arrange flax stalks for decortication. Advances in the bast plant processing, in particular, decortication using enzymatic treatments, may reduce, or possibly eliminate altogether, conventional field, pond, and/or dew retting. Such enzyme treatments are described in U.S. Patent Application Pub. No. 2010/0147472, the entirety of which is incorporated by reference into this description, International Publication No. WO 2007/140578, the entirety of which is incorporated by reference into this description, and U.S. Patent Application Pub. No. 2010/0285569, the entirety of which is incorporated by reference into this description.

Figure 2:
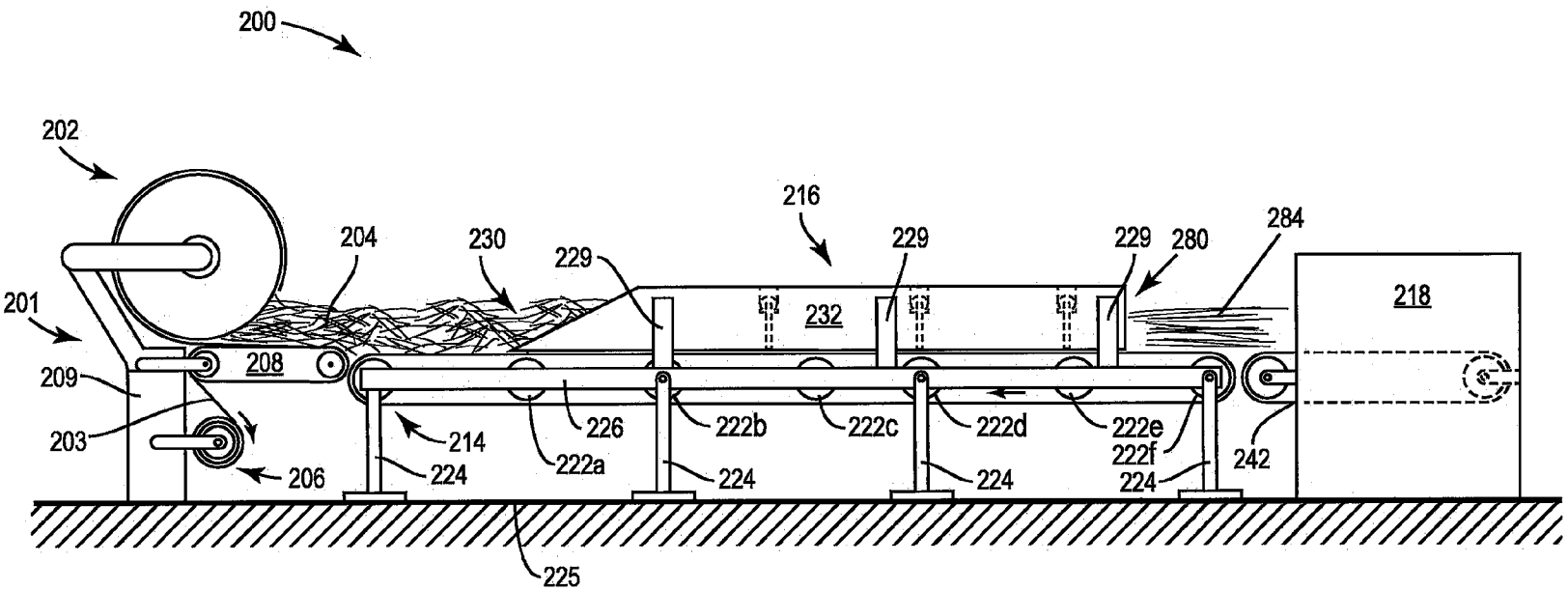
FIG. 2 is a schematic elevation view of an apparatus for arranging bast stalks according to an embodiment of the invention.
Figure 3:
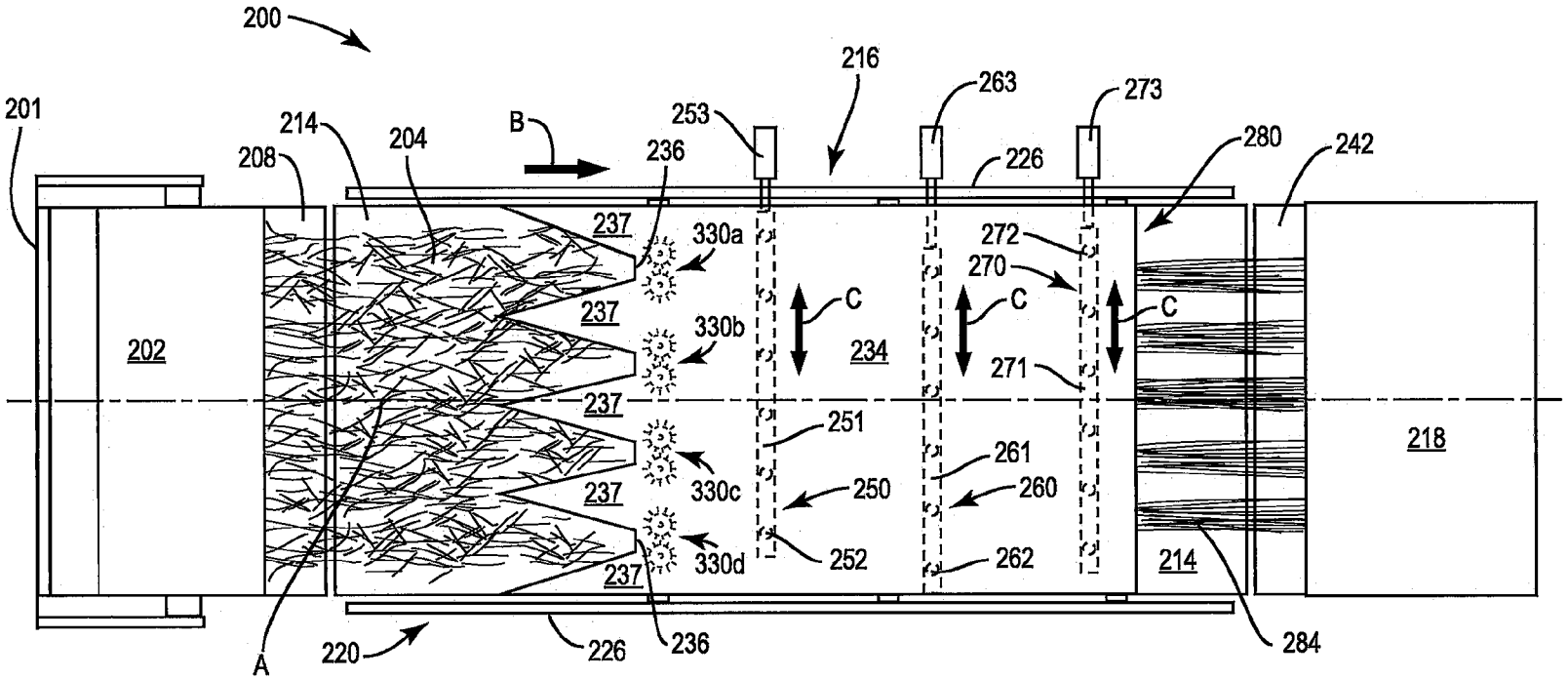
FIG. 3 is a schematic top plan view of the apparatus shown in FIG. 2.

FIGS. 2 and 3 show an apparatus 200 for orienting bast stalks for decortication. The apparatus includes the stand 201 that holds a round bale 202 of harvested bast stalks 204, a transfer belt 208, a first belt 214 transporting the bast through a chamber 216, and a decorticator 218. As can be seen in FIG. 2, the apparatus 200 initially removes the wrap 203 from the round bale 202 and presents the bast stalks 204 to the transfer belt 208. The transfer belt 208 may be any device for conveying material thereon supported by frame structure 209.

Bale properties may affect opening and orientation in later processing. The bale density ($lb/ft^3$) may be adjusted to better facilitate opening, separation and orientation of the bast stalks. The moisture content of the bale may impact bale density; as the moisture content of the bale increases, the density of the bale should be decreased, which would impact later processing. For example, a compact, dense bale may require more aggressive opening and separating to facilitate alignment later in the process compared to bales with a lower density. Conversely, bales with a lower density may need less aggressive opening and/or separation to facilitate bast stalk alignment later in the process. In alternate embodiments, when square or rectangular bales are used, a baler may compact and orient the stalk therein for later processing. For example, a bale compactor can have a surface with a plurality of extending rods having a plunger at the distal ends of the rods. As the compactor compresses the bales, the rod and plunger begin to orient the stalks in the bale.

Figure 7:
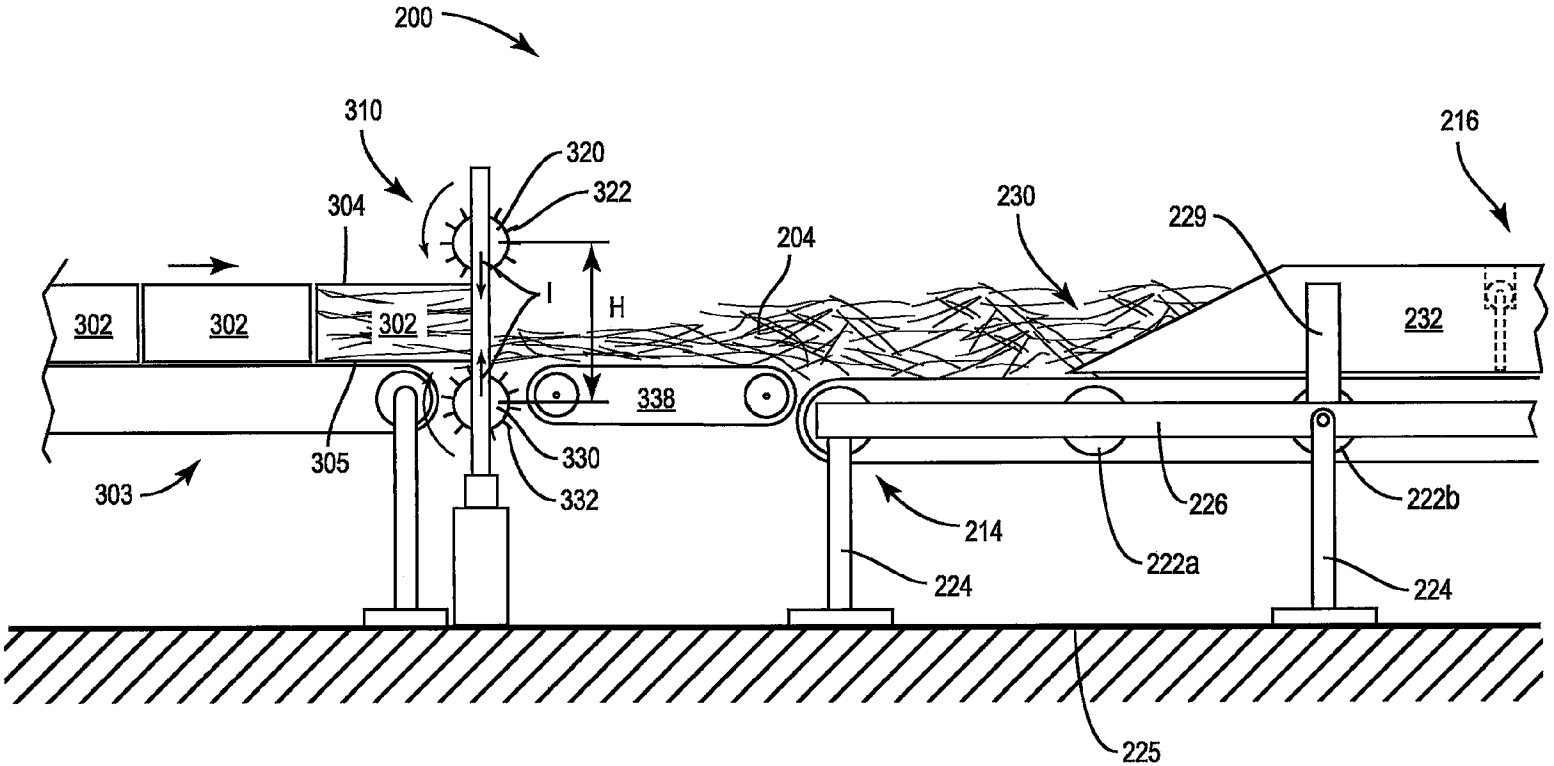
FIG. 7 is a schematic elevation view of a bale opener according to an embodiment of the invention.

As described above, the bast stalk bales may be mechanically opened to better facilitate the separation and orientation of the bast stalks. Processing a square bale, for example, may include removing the outer wrapping and wires from the bale, and partially separating the baled stalks. In an alternate design for a bale opener shown in FIG. 7, one or more square bales 302 are arranged on bale magazine 303 that presents the bales to a bale opener 310. The bale magazine 303 may be any conveyance device for presenting bales 302 to a bale opener 310. The bale opener 310 may include a first tined roller 320 and a second tined roller 330 spaced a distance of H from the first tined roller 320. The tined rollers 320 and 330 may move with respect to each other, so that distance H decreases as the bale 302 is processed by them, as will be described below. Each tined roller has a plurality of paddle shaped tines 322 and 332 extending outwardly from the roller surfaces. As shown in FIG. 7, the first tined roller 320 rotates counterclockwise and the second tined roller 330 rotates clockwise, which causes the tines 322 and 332 to grab parts of the bale 302. The first tined roller 320 extracts stalks from the top 304 of the bale 302 while the second tined roller 330 extracts from the bottom 305 of the bale 302. Each tined roller moves towards the center of the bale 302, decreasing the distance H as progressively more stalks are removed from the bale 302 and presented to the belt 338. When a section of stalks have been removed from the bale 302, a sensor is activated, which causes the tined rollers 320 and 330 to return to their original position. The bale magazine 303 indexes the bale 302 toward the opener 310, and the tined rollers begin removing the stalks therefrom, as described above. The process is repeated, and the bales are continuously fed to the process 200. The belt 338 receives and transfers the stalks to the belt 214 and chamber 214 for orientation as further described below.

A bale wrap winder 206 is disposed under the transfer belt 208 for receiving the wrap 203 (which may be plastic cords, netting, or other packaging) as the round bale 202 rotates and presents the bast stalks assembly 204 to the transfer belt 208. The winder 206 may be driven independently of the round bale 202 and transfer belt 208. However, the winder may use sensors and programmable logic controllers (PLC) to disengage when the wrap 203 is removed from the bale 202. The bale wrap may be re-used as needed.

The stand 201 shows one round bale 202 disposed thereon. The stand 201 may be modified to include one or more bales arranged in series for quick transition between one bale to the next. In alternate embodiments, the harvested bast stalks may be presented to the transfer belt 208 via any form of packaging, or by bulk deposition. For example, the stand 201 may be replaced with hopper disposed above the transfer belt 208 and holding bulk harvested bast stalks therein. In such an embodiment, the bast stalks may be metered onto the transfer belt 208 as needed. In other embodiments, the stand 201 may be modified to receive and hold square bales.

Continuing with FIGS. 2 and 3, the transfer belt 208 presents the bast stalks assembly 204 to a first belt 214, which will transport the randomly arranged bast stalks 204 in the direction B through the chamber 216 for presentation to decorticator 218. The first belt 214 has a longitudinal axis A that is parallel to the direction the first belt is moving, shown in FIG. 3 by the arrow B. The chamber 216 orients the bast stalks and will be described in more detail below. The transfer belt 208 and first belt 214 may be run with a speed differential that facilitates stalk separation during transfer. More specifically, the first belt 214 may be moving at a higher speed than the transfer belt 208. The higher speed first belt 214 separates the bast stalks so that lower density bast stalks are transported thereon compared to the higher density bast stalks received on the transfer belt 208 initially. The bast stalks are randomly disposed on the belt 214 about the longitudinal axis A entering the chamber 216.

As shown in FIGS. 2 and 3, a frame structure 220 supports the first belt 214 and chamber 216. A first set of vertical frame members 224 extend from the floor 225 and are connected to a horizontal frame 226 elevated above the floor 225. The first belt 214 is shown as a single conveyer belt around a plurality of rollers 222*a*, 222*b*, 222*c*, 222*d*, 222*e*, and 222*f*. While the belt 214 is shown in FIGS. 2 and 3 as a single conveyor, the belt 214 may comprise multiple belts arranged end-to-end, each progressing the bast stalks through the chamber 216 at a different or same speed. In such an embodiment, the speed of each belt may be adjusted to facilitate stalk transportation. For example, the belt 214 may comprise a first portion and a second portion, wherein the second portion has a speed that is greater than the first portion. When the bast stalks pass from the first portion to the second portion, the bast stalks partially separate from one another. For example, the mass of bast stalks on the second portion may be less than the mass of bast stalks on the first portion.

Figure 5A:
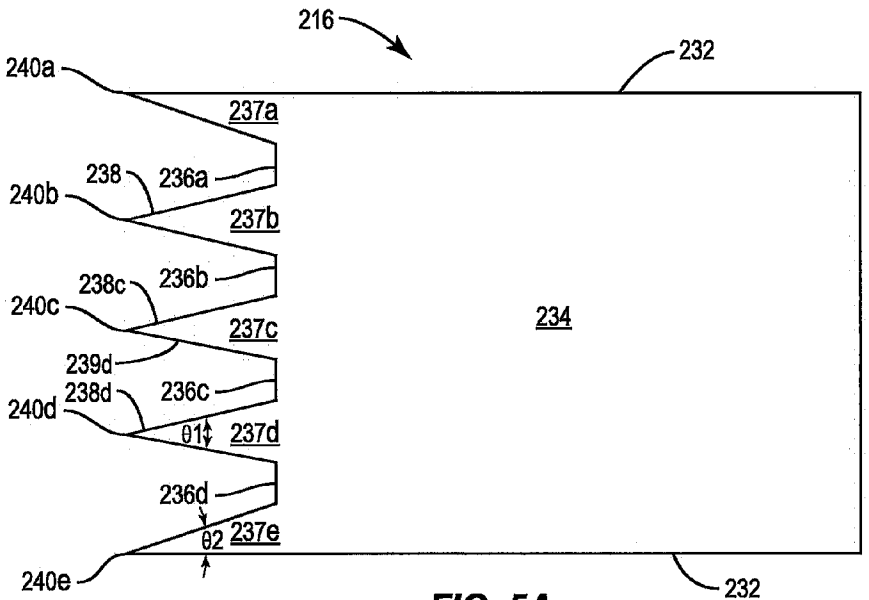
FIGS. 5A and 5B is a top view and front elevation view of a chamber used to orient the bast stalks according to an embodiment of the invention.
Figure 5B:
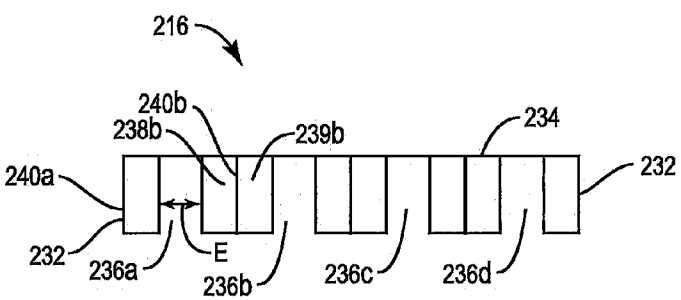

Turning now to FIGS. 2, 3 and 5A, the orienting chamber 216 includes an inlet end 230 with a plurality of guides 237 and ports 236 that receive the randomly disposed bast stalks 204, and an outlet end 280 through which the oriented bast stalks pass. A substantial portion of the bast stalks are oriented generally parallel with the longitudinal axis A when exiting the chamber 216 for transfer to decorticator 218. A plurality of spindle sets 330 facilitates transfer of the bast stalks through the ports 236 toward the bars 250, 260, and 270. The plurality of bars 250, 260, and 270 cooperate to orient the bast stalks on the belt 214 in the chamber 216, and will be detailed below.

Continuing with FIGS. 2, 3 and 5A, the chamber 216 has a top, side walls 232 and an open bottom (not shown). A second plurality of vertical frames 229 connected to the horizontal member 226 position the chamber 216 over the first belt 214. The elevation of the chamber 216 above the belt 214 may be modified as needed. In other embodiments, the first belt 214 may pass into and through the chamber 216.

The chamber inlet end 230 is configured to orient a portion of the bast stalks 204 on the first belt 214. As shown in FIGS. 2, 3, 5A and 5B, the inlet end 230 has a plurality of ports 236*a*, 236*b*, 236*c*, and 236*d* through which the bast stalks pass. A plurality of guides 237*a*, 237*b*, 237*c*, 237*d* and 237*e* direct the bast stalks toward and into the ports 236. The guides 237 are formed by side walls 238 and 239 that terminate at the ports 236 to form a space having a dimension of E. An apex 240 defines where the side walls 238 and 239 meet. For example, the side walls 238*b* and 239*b* form apex 240*b*. The apex 240 may be curved to direct stalks toward the ports on either side of the apex 240.

Adjacent side walls 238, 239 in each guide form a first angle (θ1) therebetween. The outermost guides 237*a* and 237*e* adjacent the ports 236*a* and 236*d*, respectively, are formed by chamber sides 232 and one of the guide side walls. These outermost guides 237*a* and 237*e* may form a second angle (θ2). The port spacing E, first angle θ1, second angle θ2 may be modified as needed to direct the stalks into the chamber 216. The side walls 238, 239 may also slope downward from the top 234 of the chamber toward the belt 214.

The guides 237 may have moveable side walls 238 and 239 configured to accommodate bast stalks 204 received therethrough. In an embodiment, a hinge (not shown) at the apex 240 operably connects the side walls 238 and 239. The hinge allows the side walls 238 and 239 to pivot at the apex 240 thereby expanding the spacing E so that bast stalks can more easily pass through the port 236. The side walls 238 and 239 can be automatically adjusted using an actuator (not shown) suspended from the undersurface of the chamber top 234. In other embodiments, the side walls may be manually adjusted.

In other embodiments, the side walls 238 and 239 may be operably connected to an actuator capable of displacing the of the side walls 238 and 239 in a direction orthogonal to the longitudinal axis A of the belt (not shown). In such an embodiment, the apex 240 may be a plate (not shown) positioned on the inlet end-side of the guides 237 and adjacent side walls 238 and 239. The plate may have a "V" shape, or may be curved. The separate plate would allow the side walls to move laterally as described above, while still providing a surface to deflect the stalks into the port.

The chamber 216 may have a coating on the bast stalk contacting surfaces to facilitate bast stalk transfer, e.g., the coating may reduce the coefficients of friction of the chamber. The surfaces of the guides 237 and tines 252, 262, 272 may include such a coating. The coating may include polytetrafluoroethylene (PTFE),e.g., TEFLON® available from E.I. Du Pont De Nemours and Company, of Wilmington, Del. Other components and/or additives may be used in the coating.

As the first belt 214 conveys the partially separated bast stalk assembly 204 toward the chamber 216, the stalks engage guide apex 240, and through movement of belt 214 are redirected into the ports 236. Because of the funnel-like design of the guides 237 and ports 236, a portion of the bast stalks begin to align with the longitudinal axis A of the first belt 214.

Figure 6A:
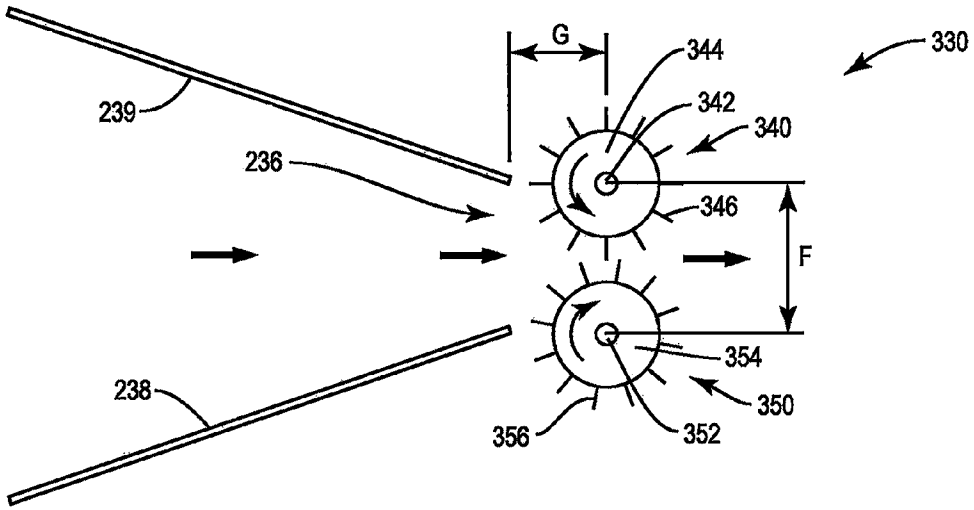
FIG. 6A is a top view of a portion of the chamber shown in FIG. 5A.
Figure 6B:
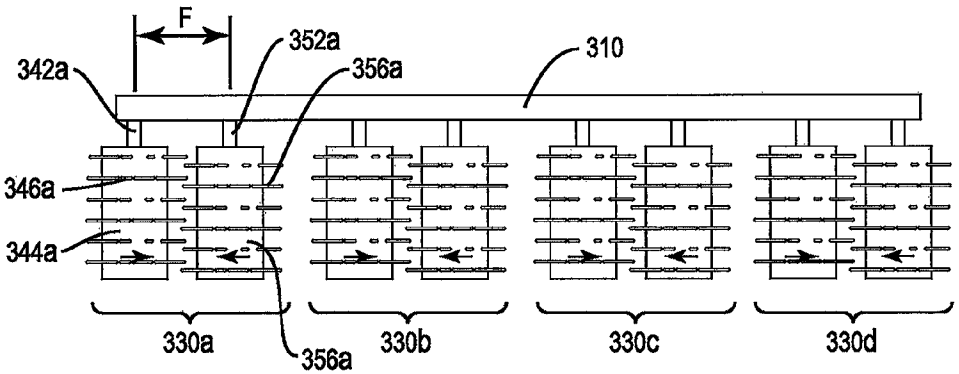
FIG. 6B is a front elevation view of spindle sets used in the chamber according to an embodiment of the invention.

As shown in FIGS. 3, 6A and 6B, the chamber 216 includes a plurality of spindle sets 330 positioned proximate the ports 236, which may be used to pull bast stalks through the ports 236. Turning initially to FIGS. 6A and 6B, a plurality of spindle sets 330*a*, 330*b*, 330*c*, and 330*d* are suspended from the support 310 and extend toward the belt 214 (not shown). The spindle sets 330 include a first spindle 340*a* positioned a distance F from a second spindle 350*a*. Each spindle in the set rotates in a different direction. For example, the first spindle 340 rotates counterclockwise while the second spindle 350 rotates clockwise as shown, or vice versa. The spindle sets 330 may be positioned a distance D from the distal ends of the guide side walls 239 and 238. The distances D and F may be modified automatically or manually as needed, depending on the size of the port 236, the speed of the belt 214, and how the bast stalks are progressing through the chamber 216. If the bast stalks accumulate at the ports 236, the spacings E (see FIG. 5B), G and G may be modified.

Each spindle 340, 350 includes a shaft 342, 352, a spindle body 344, 354 on the shaft, and projections 346, 356 extending outwardly from the body 344, 354. The spindles may be direct driven, i.e., each spindle has an independent drive. In direct driven embodiments, an integrally housed spindle motor (not shown) rotates the shaft 342, 352 thereby rotating the spindle body 344, 354. Direct driven spindles allow the counter rotation of the spindles 340 and 350, which facilitates bast stalk transfer through the ports 236 as described above. In other embodiments, gears/and or belt driven spindles may be used.

Figure 4:
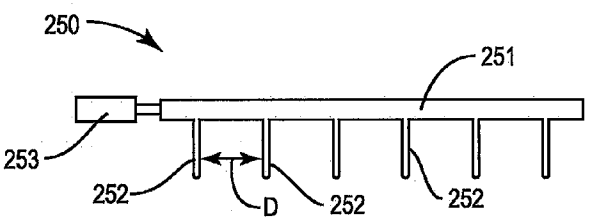
FIG. 4 shows a bar used to facilitate orientation of the bast stalks according to an embodiment of the invention.

As shown in FIGS. 2 and 3, the chamber 216 includes a plurality of bars 250, 260, 270 elevated above the first belt 214, and further orient the bast stalks parallel to the longitudinal axis A of the first belt 214. In the embodiment shown in FIG. 3, the bars 250, 260, and 270 are perpendicular to the longitudinal axis A the belt 214. The bars 250, 260, 270 are capable of oscillating back and forth across the belt in the direction C, as indicated by the arrows. Each bar also includes a horizontal support 251, 261, 271, and a plurality of tines 252, 262, 272 that extend downwardly and orthogonally toward the belt 214. As shown in FIG. 4, the tines 252 are spaced apart a distance D so that bast stalks may pass therethrough. The tines 252 are shown attached to the support 251. The tines 252 may be attached to the support 251 by mechanical fasteners.

Actuators 253, 263, 273 may cause the bars 250, 260, 270 to move back and forth across the longitudinal axis A of the first belt 214 as shown. Each of the bars 250, 260, 270 may be independently movable. Further, the bars may oscillate with respect to each other in a coordinated manner to maximize orientation of the bast stalks. For example, the first bar may oscillate at a first frequency and the second bar at a second frequency that is lower than the first frequency. The third bar may still oscillate at a lower frequency than the first and second bars. Frequency refers to the rate the bar completes one cycle back and forth across the belt.

Continuing with FIGS. 2 and 3, as the bast stalks approach the first oscillating bar 250 within the chamber 216, the tines 252 begin to separate and orient the stalks. The partially oriented stalks are then presented to the second bar 260 oscillating across the longitudinal axis A of the belt 214. The tines 262 arrange the stalks within the spacings D to further orient the stalks generally parallel to the longitudinal axis A of the first belt 214. The stalks are then presented to the final bar 270 and tines 272, wherein movement of the tines 272 over the moving belt 214 cause further orientation of the bast stalks. Although three bars 250, 260 and 270 are shown, more or less may be used.

The process can be configured to reprocess and orient stalks that are not aligned within predetermined parameters. For example, one or more sections of the belts 214 can have an opening configured so that stalks having an alignment angle greater than 45 degrees with respect to longitudinal axis A may be extracted from the belt 214 therethrough. The stalks may be redirected via an air assisted vacuum tunnel (not shown) to pass through the chamber 214 again. In still other embodiments, a separate belt receives such stalks and conveys them through a second chamber (not shown) similar to chamber 214, to orient the stalks. The oriented stalks may then be re-presented to the decorticator 218. In still other embodiments, the alignment angle beyond which bast stalks are extracted and reprocessed may be higher or lower than 45 degrees.

Figure 8:
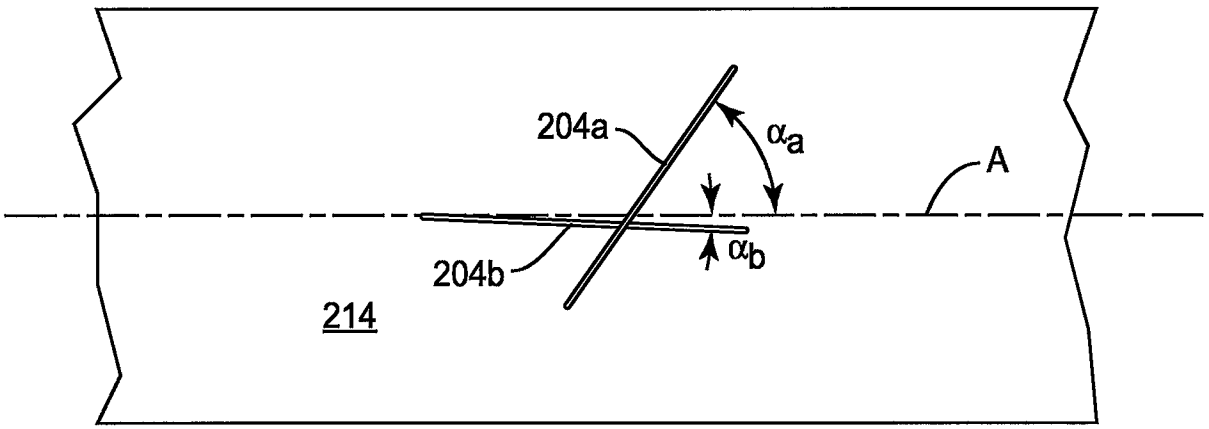
FIG. 8 is a schematic of bast stalks oriented on a belt.

Continuing with FIGS. 2, 3 and 8, the oriented bast stalks 284 exit the outlet end 280 of the chamber 216 substantially aligned with the longitudinal axis A of the first belt 214. The oriented bast stalks 284 are transferred to the second transfer belt 242 for presentation to decorticator 218. In other embodiments, the oriented bast stalks may be packaged for transport to decortication. Turning to FIG. 8, the stalk alignment angle ($\alpha$) as used herein refers to the angle between the longitudinal axis of a bast stalk and the longitudinal axis A of the belt. For example, when the bast stalk is parallel longitudinal axis A, the stalk alignment angle ($\alpha$) will be approximately 0 degrees. In the example shown in FIG. 8, the bast stalk 204*a* has a stalk alignment angle ($\alpha a$) of about 55 degrees, and stalk 204*b* has a stalk alignment angle ($\alpha b$) of about 5 degrees. Variables such as belt speed(s), orienting bar settings, and stalk density on the belt may affect the stalk alignment angles. Each variable may independently be modified as needed to optimize the orientation of the stalks as they enter and pass through decorticator 218.

Belts 208, 214 and 242 may operate at different speeds to facilitate stalk separation and orientation. In one embodiment, the belt 214 may operate at a higher speed than belt 208, and belt 242 may operate at a higher speed than belt 214 and belt 208. The speed differential among the belts 208, 214 and 242 separates the bast stalk assembly as it progresses through the process 200. In an alternate embodiment, the belts 208, 214 and 242 may be comprised of several independently driven sections, each of which may be set to different speeds to further separate and orient the bast stalks as they are processed as described herein. For example, the speed of the belt sections (not shown) of belt 208 may gradually increase from the point the bale 202 is presented to the belt 208 toward the point where the stalks are transferred to belt 214. Belt 214 may be comprised of multiple independently driven sections that have progressively increasing speeds. For example, the belt section (not shown) and belt 214 proximate the decorticator 218 may have a higher speed than the belt sections proximate to belt 208. Again, belt 242 may have multiple independently driven sections with the decorticator (not shown) that have progressively increasing speeds.

Decorticator 218 may remove the fibers from the bast stalks. In an embodiment, as described above. An enzyme treatment may be used to remove the fibers from the bast stalks. For example, the enzyme treatments as described in U.S. Patent Application Pub. No. 2010/0147472, the entirety of which is herein incorporated by reference, International Publication No. WO 2007/140578, the entirety of which is herein incorporated by reference, and U.S. Patent Application Pub. No. 2010/0285569, the entirety of which is herein incorporated by reference. The decorticator may maintain alignment of stalks. In an embodiment, the stalk alignment angle ($\alpha$) of between about 0 degrees to about 20 degrees may be acceptable for presentation to yarn processing systems.

Although the present invention has been described with exemplary embodiments, it is to be understood that modifications and variations may be utilized without departing from the spirit and scope of the invention, as those skilled in the art will readily understand. Such modifications and variations are considered to be within the purview and scope of the appended claims and their equivalents.

What is claimed is:

1. A process for orienting a plurality of bast stalks for decortication, the process comprising:
   a. receiving a plurality of harvested bast stalks onto a moving belt, the belt having a longitudinal axis in the direction the belt is moving;
   b. orienting a substantial portion of the plurality of harvested bast stalks on the belt so that the harvested bast stalks are generally parallel to the longitudinal axis of the belt; and
   c. collecting the oriented plurality of bast stalks for decortication.

2. The process of claim 1, wherein the step of orienting further comprises passing the plurality of harvested bast stalks under at least one bar that is elevated above the belt, the at least one bar having a plurality of downwardly extending tines, wherein the at least one bar oscillates across the longitudinal axis of the belt.

3. The process of claim 1, wherein the step of orienting further comprises transporting the plurality of harvested bast stalks on the belt through a chamber.

4. The process of claim 3, wherein the step of transporting further comprises directing at least a portion of the harvested stalks through the chamber, the chamber having an inlet end and outlet end, the inlet end comprising a plurality of ports having on either side walls for directing the portion of the harvested stalks through the ports.

5. The process of claim 4, wherein the step of directing further comprises partially orienting and separating the plurality of harvested bast stalks via the inlet end.

6. The process of claim 5, wherein the step of decorticating further comprises treating the bast stalks with an enzyme.

7. The process of claim 1, wherein the belt comprises a first portion and a second portion, the second portion having speed greater than the first portion so that when the bast stalks pass from the first portion to the second portion, the plurality of bast stalks partially separate from each other.

8. The process of claim 1, further comprising decorticating the bast stalks.

9. The process of claim 1, wherein the step of receiving further comprises receiving the bast stalks from a round bale of harvested bast stalks.

10. The process of claim 9, wherein the step of receiving further comprises unwrapping the round bale of harvested bast stalk onto a transfer belt.

11. The process of claim 10, wherein the step at receiving further comprises transferring the harvested bast stalks onto a transfer belt.

12. A process for orienting a plurality of bast stalks for decortication, the process comprising:

a. receiving a plurality of harvested bast stalks onto a moving belt, the belt having a longitudinal axis in the direction the belt is moving;

b. orienting a substantial portion of the plurality of harvested bast stalks on the belt by passing the plurality of harvested bast stalks under at least one bar that is elevated above the belt, the at least one bar having a plurality of downwardly extending tines, wherein the at least one bar oscillates across the longitudinal axis of the belt to orient the harvested bast stalks generally parallel to the longitudinal axis of the belt; and c. collecting the oriented plurality of bast stalks for decortication.

13. The process of claim 12, wherein the step of orienting further comprises transporting the plurality of harvested bast stalks on the belt through a chamber.

14. The process of claim 12, wherein the step of transporting further comprises directing at least a portion of the harvested stalks through the chamber, the chamber having an inlet end and an outlet end, the inlet end comprising a plurality of ports having on either side walls for directing the portion of the harvested stalks through the ports.

15. The process of claim 12, wherein the step of directing further comprises partially orienting and separating the plurality of harvested bast stalks via the inlet end.

16. The process of claim 15, wherein the step of decorticating further comprises treating the bast stalks with an enzyme.

17. The process of claim 12, wherein the belt comprises a first portion and a second portion, the second portion having speed greater than the first portion so that when the bast stalks pass from the first portion to the second portion, the plurality of bast stalks partially separate.

18. The process of claim 12, further comprising decorticating the bast stalks.

19. The process of claim 12, wherein the step of receiving step further comprises receiving the bast stalks from a round bale of harvested bast stalks.

20. The process of claim 19, wherein the step of receiving further comprises unwrapping the round bale of harvested bast stalk onto a transfer belt.

21. The process of claim 20, wherein the step of receiving further comprises transferring the harvested bast stalks onto a transfer belt.

* * * * *